US006634300B2

(12) United States Patent
Reese et al.

(10) Patent No.: US 6,634,300 B2
(45) Date of Patent: Oct. 21, 2003

(54) SHAPED CHARGES HAVING ENHANCED TUNGSTEN LINERS

(75) Inventors: James Warren Reese, Spring, TX (US); David Betancourt, Cypress, TX (US); Nathan Clark, Mansfield, TX (US); Terry Slagle, Cypress, TX (US)

(73) Assignee: Baker Hughes, Incorporated, Houston, TX (US)

( * ) Notice: Subject to any disclaimer, the term of this patent is extended or adjusted under 35 U.S.C. 154(b) by 0 days.

(21) Appl. No.: 09/860,119

(22) Filed: May 17, 2001

(65) Prior Publication Data

US 2002/0185030 A1 Dec. 12, 2002

Related U.S. Application Data

(60) Provisional application No. 60/206,101, filed on May 20, 2000.

(51) Int. Cl.[7] ..... F42B 1/02

(52) U.S. Cl. ..... 102/307; 102/306; 102/476

(58) Field of Search ..... 102/306, 307, 102/309, 476

(56) References Cited

U.S. PATENT DOCUMENTS

| | | | | |
|---|---|---|---|---|
| 3,675,575 A | | 7/1972 | Bailey et al. | 102/24 HC |
| 4,498,367 A | | 2/1985 | Skolnick et al. | 102/306 X |
| 4,613,370 A | | 9/1986 | Held et al. | 102/306 X |
| 4,766,813 A | | 8/1988 | Winter et al. | 102/307 |
| 4,836,108 A | * | 6/1989 | Kegel et al. | 102/476 X |
| 4,858,531 A | * | 8/1989 | Lindstadt et al. | 102/476 X |
| 5,098,487 A | * | 3/1992 | Braver et al. | 102/476 X |
| 5,119,729 A | * | 6/1992 | Nguyen | 102/476 X |
| 5,221,808 A | | 6/1993 | Werner et al. | 102/307 |
| 5,279,228 A | | 1/1994 | Ayer | 102/306 |
| 5,413,048 A | | 5/1995 | Werner et al. | 102/307 |
| 5,567,906 A | | 10/1996 | Reese et al. | 102/307 |
| 5,597,974 A | * | 1/1997 | Voreck, Jr. et al. | 102/307 |
| 5,656,791 A | | 8/1997 | Reese et al. | 102/307 |
| 5,698,814 A | * | 12/1997 | Parsons et al. | 102/307 X |
| 5,753,850 A | * | 5/1998 | Chawla et al. | 102/476 X |
| 5,760,331 A | * | 6/1998 | Lowden et al. | 102/506 |
| 5,814,758 A | | 9/1998 | Leidel | 102/307 |
| 5,939,664 A | * | 8/1999 | Kapoor | 102/307 X |
| 6,012,392 A | * | 1/2000 | Norman et al. | 102/307 |

* cited by examiner

*Primary Examiner*—Peter A. Nelson
(74) *Attorney, Agent, or Firm*—Darryl M. Springs; Keith R. Derrington

(57) ABSTRACT

A liner for a shaped charge formed from a mixture of powdered heavy metal and a powdered metal binder. The liner is formed by compression of the mixture into a liner body. In one embodiment of the invention, the mixture comprises a range of 50 to 93 percent by weight of tungsten, and 50 to 7 percent by weight of the powdered metal binder. In a specific embodiment of the invention, graphite powder is intermixed with the powdered metal binder to act as a lubricant during formation of the shaped charge liner. The powdered metal binder can be a combination of copper powder, lead, and molybdenum.

44 Claims, 1 Drawing Sheet

SHAPED CHARGES HAVING ENHANCED TUNGSTEN LINERS

RELATED APPLICATIONS

This application claims priority from co-pending U.S. Provisional Application No. 60/206,101, filed May 20, 2000, the full disclosure of which is hereby incorporated by reference herein.

BACKGROUND OF THE INVENTION

1. Field of the Invention

The invention relates generally to the field of explosive shaped charges. More specifically, the present invention relates to a composition of matter for use as a liner in a shaped charge, particularly a shaped charge used for oil well perforating.

2. Description of Related Art

Shaped charges are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore.

Shaped charges known in the art for perforating wellbores are used in conjunction with a perforation gun and the shaped charges typically include a housing, a liner, and a quantity of high explosive inserted between the liner and the housing where the high explosive is usually HMX, RDX, PYX, or HNS. When the high explosive is detonated, the force of the detonation collapses the liner and ejects it from one end of the charge at very high velocity in a pattern called a "jet". The jet penetrates the casing, the cement and a quantity of the formation. The quantity of the formation which may be penetrated by the jet can be estimated for a particular design shaped charge by test detonation of a similar shaped charge under standardized conditions. The test includes using a long cement "target" through which the jet partially penetrates. The depth of jet penetration through the specification target for any particular type of shaped charge relates to the depth of jet penetration of the particular perforation gun system through an earth formation.

In order to provide perforations which have efficient hydraulic communication with the formation, it is known in the art to design shaped charges in various ways to provide a jet which can penetrate a large quantity of formation, the quantity usually referred to as the "penetration depth" of the perforation. One method known in the art for increasing the penetration depth is to increase the quantity of explosive provided within the housing. A drawback to increasing the quantity of explosive is that some of the energy of the detonation is expended in directions other than the direction in which the jet is expelled from the housing. As the quantity of explosive is increased, therefore, it is possible to increase the amount of detonation-caused damage to the wellbore and to equipment used to transport the shaped charge to the depth within the wellbore at which the perforation is to be made.

The sound speed of a shaped charge liner is the theoretical maximum speed that the liner can travel and still form a coherent "jet". If the liner is collapsed at a speed (collapse speed) that exceeds the sound speed of the liner material the resulting jet will not be coherent. A coherent jet is a jet that consists of a continuous stream of small particles. A non-coherent jet contains large particles or is a jet comprised of multiple streams of particles. The sound speed of a liner material is calculated by the following equation, sound speed=(bulk modulus/density)$^{1/2}$(Equation 1.1). However, an increased collapse speed will yield increased jet tip speeds. Increased jet tip speeds are desired since an increase in jet tip speed increases the kinetic energy of the jet which in turn provides increased well bore penetration. Therefore, liner materials having higher sound speeds are preferred because this provides for increased collapse speeds while maintaining jet coherency.

Accordingly, it is important to supply a detonation charge to the shaped charge liner that does not cause the shaped charge liner to exceed its sound speed. On the other hand, to maximize penetration depth, it is desired to operate shaped charge liners at close to their sound speed and to utilize shaped charge liners having maximum sound speeds. Furthermore, it is important to produce a jet stream that is coherent because the penetration depth of coherent jet streams is greater than the penetration depth of non-coherent jet streams.

As per Equation 1.1 adjusting the physical properties of the material of the shaped charge liner can affect the sound speed of the liner. Furthermore, this adjustment can be made to increase the maximum allowable speed to form a coherent jet. As noted previously, knowing the sound speed of a shaped charge liner is important since a non-coherent jet will be formed if the collapse speed of the liner well exceeds the sound speed.

It is also known in the art to design the shape of the liner in various ways so as to maximize the penetration depth of the shaped charge for any particular quantity of explosive. Even if the liner geometry and sound speed of the shaped charge liner is optimized, the amount of energy which can be transferred to the liner for making the perforation is necessarily limited by the quantity of explosive.

Shaped charge performance is dependent on other properties of the liner material. Density and ductility are properties that affect the shaped charge performance. Optimal performance of a shaped charge liner occurs when the jet formed by the shaped charge liner is long, coherent and highly dense. The density of the jet can be controlled by utilizing a high density liner material. Jet length is determined by jet tip velocity and the jet velocity gradient. The jet velocity gradient is the rate at which the velocity of the jet changes along the length of the jet whereas the jet tip velocity is the velocity of the jet tip. The jet tip velocity and jet velocity gradient are controlled by liner material and geometry. The higher the jet tip velocity and the jet velocity gradient the longer the jet.

In solid liners, a ductile material is desired since the solid liner can stretch into a longer jet before the velocity gradient causes the liner to begin fragmenting. In porous liners, it is desirable to have the liner form a long, dense, continuous stream of small particles. To produce a coherent jet, either from a solid liner or a porous liner; the liner material must be such that the liner does not splinter into large fragments after detonation.

The solid shaped charge liners are formed by cold working a metal into the desired shape, others are formed by adding a coating onto the cold formed liner to produce a composite liner. Information relevant to cold worked liners is addressed in Winter et al., U.S. Pat. No. 4,766,813, Ayer U.S. Pat. No. 5,279,228, and Skolnick et al., U.S. Pat. No. 4,498,367. However, solid liners suffer from the disadvantage of allowing "carrots" to form and become lodged in the resulting perforation—which reduces the hydrocarbon flow from the producing zone into the wellbore. Carrots are sections of the shaped charge liner that form into solid slugs after the liner has been detonated and do not become part of the shaped charge jet. Instead, the carrots can take on an oval shape, travel at a velocity that is lower than the shaped charge jet velocity and thus trail the shaped charge jet.

Porous liners are formed by compressing powdered metal into a substantially conically shaped rigid body. Typically, the liners that have been formed by compressing powdered metals have utilized a composite of two or more different metals, where at least one of the powdered metals is a heavy or higher density metal, and at least one of the powdered metals acts as a binder or matrix to bind the heavy or higher density metal. Examples of heavy or higher density metals used in the past to form liners for shaped charges have included tungsten, hafnium, copper, or bismuth. Typically the binders or matrix metals used comprise powdered lead, however powdered bismuth has been used as a binder or matrix metal. While lead and bismuth are more typically used as the binder or matrix material for the powdered metal binder, other metals having high ductility and malleability can be used for the binder or matrix metal. Other metals which have high ductility and malleability and are suitable for use as a binder or matrix metal comprise zinc, tin, uranium, silver, gold, antimony, cobalt, copper, zinc alloys, tin alloys, nickel, and palladium. Information relevant to shaped charge liners formed with powdered metals is addressed in Werner et al., U.S. Pat. No. 5,221,808, Werner et al., U.S. Pat. No. 5,413,048, Leidel, U.S. Pat. No. 5,814,758, Held et al. U.S. Pat. No. 4,613,370, Reese et al., U.S. Pat. No. 5,656,791, and Reese et al., U.S. Pat. No. 5,567,906.

However, each one of the aforementioned references related to powdered metal liners suffer from the disadvantages of liner creep, and/or a high percentage of binder material in the material mix. Liner creep involves the shaped charge liner slightly expanding after the shaped charge has been assembled and stored. Slight expansion of the shaped charge liner reduces shaped charge effectiveness and repeatability.

The binder or matrix material typically has a lower density than the heavy metal component. Accordingly the overall density of the shaped charge liner is reduced when the binder or matrix material possesses a lower density. Reducing the overall density of the shaped charge liner reduces the penetration depth produced by the particular shaped charge. However, implementation of a higher density binder or matrix material will increase the overall density of the shaped charge liner thereby increasing the penetration depth produced by the shaped charge.

The sound speed of the shaped charge liner constituents affect the sound speed of the shaped charge liner. Therefore, increasing the sound speed of the binder or matrix material will in turn increase the sound speed of the shaped charge liner. Since shaped charge liners having increased sound speeds also exhibit better performance by the increased penetration depths, advantages can be realized by implementing binder or matrix materials having increased sound speeds.

Therefore, it is desired to produce a shaped charge liner that is not subject to creep, has an improved overall density, and a high sound speed.

BRIEF SUMMARY OF THE INVENTION

The present invention solves a number of the problems inherent in the prior art by providing a liner for a shaped charge comprising a mixture of powdered heavy metal and powdered metal binder wherein the powdered heavy metal comprises from 50 percent by weight of the mixture to 90 percent by weight of the mixture. The powdered metal binder comprises from 50 percent by weight of the mixture to 10 percent by weight of the mixture. The liner for a shaped charge is formed by compressing the mixture into a liner body. The liner for a shaped charge further comprises powdered graphite intermixed with the powdered heavy metal and the powdered metal binder to act as a lubricant. The preferred powdered heavy metal is tungsten, and the preferred powdered metal binder is a combination of a copper-lead-graphite powder, lead, and molybdenum. Other and further features and advantages will be apparent from the following description of presently preferred embodiments of the invention given for the purpose of disclosure.

DETAILED DESCRIPTION OF THE INVENTION

Figure 1:
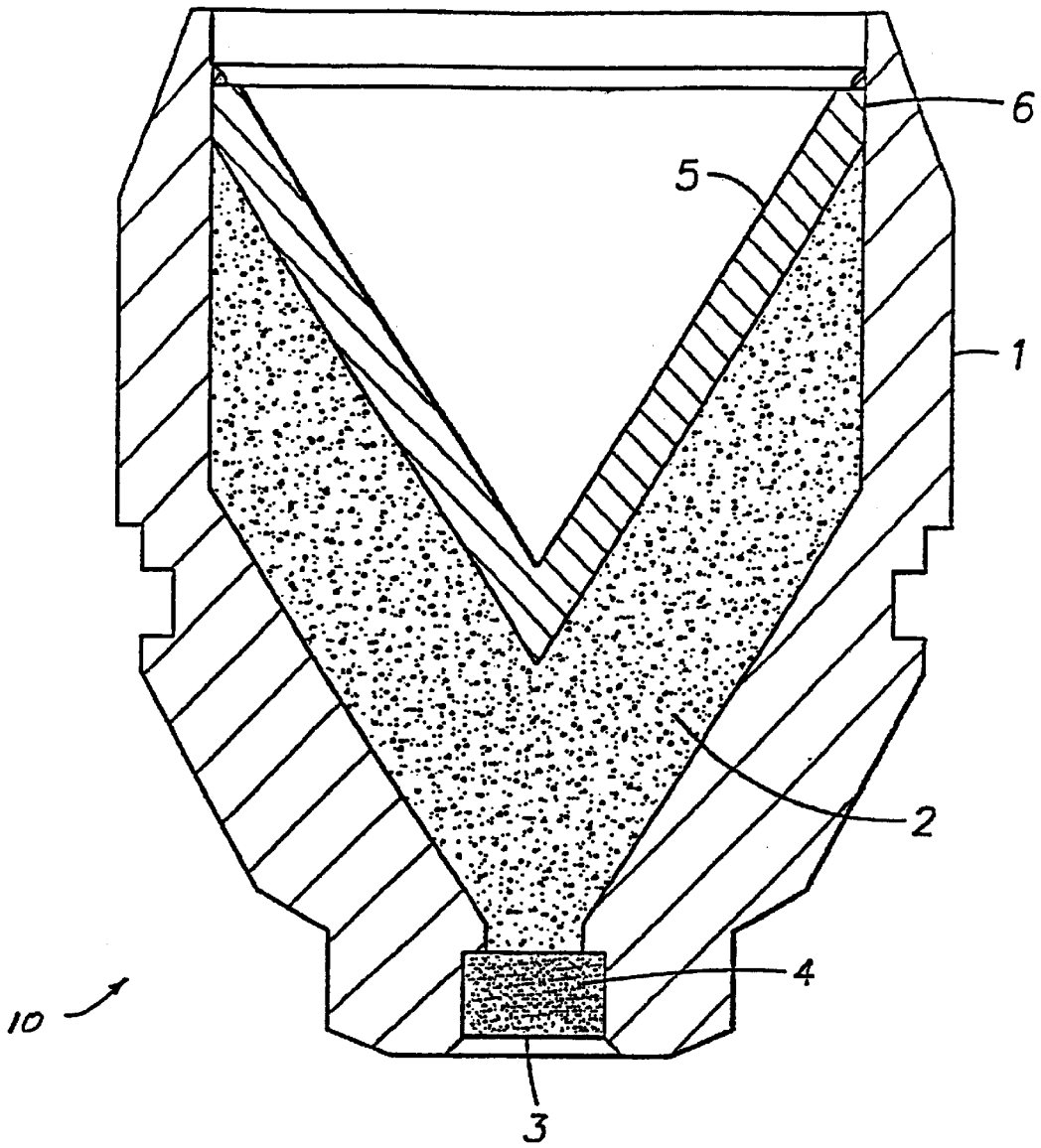
FIG. 1 depicts a cross-sectional view of a shaped charge with a liner according to the present invention.

With reference to the drawings herein, a shaped charge 10 according to the invention is shown in FIG. 1. The shaped charge 10 typically includes a generally cylindrically shaped housing 1, which can be formed from steel, ceramic or other material known in the art. A quantity of high explosive powder, shown generally at 2, is inserted into the interior of the housing 1. The high explosive 2 can be of a composition known in the art. High explosives known in the art for use in shaped charges include compositions sold under trade designations HMX, HNS, RDX, PYX, and TNAZ. The booster explosive, as is understood by those skilled in the art, provides efficient transfer to the high explosive 2 of a detonating signal provided by a detonating cord (not shown) which is typically placed in contact with the exterior of the recess 4. The recess 4 can be externally covered with a seal, shown generally at 3.

A liner, shown at 5, is typically inserted on to the high explosive 2 far enough into the housing 1 so that the high explosive 2 substantially fills the volume between the housing 1 and the liner 5. The liner 5 in the present invention is typically made from powdered metal which is pressed under very high pressure into a generally conically shaped rigid body. The conical body is typically open at the base and is hollow. Compressing the powdered metal under sufficient pressure can cause the powder to behave substantially as a solid mass. The process of compressively forming the liner from powdered metal is understood by those skilled in the art.

As will be appreciated by those skilled in the art, the liner 5 of the present invention includes but is not limited to conical or frusto-conical shapes, but can be formed into numerous shapes. Additional liner shapes can include bi-conical, tulip, hemispherical, circumferential, linear, and trumpet. As is further understood by those skilled in the art, when the explosive 2 is detonated, either directly by signal transfer from the detonating cord (not shown) or transfer through the booster explosive (not shown), the force of the detonation collapses the liner 5 and causes the liner 5 to be formed into a jet, once formed the jet is ejected from the housing 1 at very high velocity.

A novel aspect of the present invention is the composition of the powdered metal from which the liner 5 can be formed. The powdered metal mixture of the liner 5 of the present invention is comprised of 50 percent to 90 percent by weight of a powdered heavy metal, and 50 percent to 10 percent by weight of a powdered metal binder. The preferred ratio of the powdered metal mixture ranges from 80 to 85 percent by weight of a powdered heavy metal and from 15 to 20 percent by weight of a powdered metal binder. The preferred powdered heavy metal is powdered tungsten which is commercially available. Optionally, a lubricant, such as graphite powder or oil can be added to the powdered metal mixture. The graphite powder can be added to the powdered metal mixture up to 1.0 percent by weight of the powdered metal mixture.

An additional option regarding the powdered heavy metal is to utilize a bi-modal metal. Bi-modal describes a mixture created by blending increments of powdered heavy metal having a large particle size with increments of powdered heavy metal having a smaller particle size. The smaller particles occupy the vacancies that exist between the larger particles. Replacing the interstices between the larger particles with the relatively high density powdered heavy metal increases the overall density of the liner, thereby enhancing shaped charge effectiveness.

The powdered metal binder can be comprised of the highly ductile or malleable metals selected from the group consisting of lead, bismuth, zinc, tin, uranium, silver, gold, antimony, cobalt, copper, zinc alloys, tin alloys, nickel, copper, and palladium. The preferred metal binder is comprised of either copper powder, lead, molybdenum, or a mixture of some or all of these. The preferred metal binder mix is 9 percent copper powder by weight of the liner, 6 percent lead by weight of the liner, and 4 percent molybdenum by weight of the liner. The copper powder can be comprised of either pure copper or a mixture of copper, lead, and graphite powder (CLG-80). The CLG-80 powder is a mixture of 78 to 81 percent by weight of pure copper powder, 18 to 20 percent by weight of lead powder, and 0.9 to 1.0 percent by weight of graphite. The copper powder however, like all of the liner constituents, should be in powder form. The addition of the lubricant will weight for weight reduce the amount of binder material of the mixture.

Integrating molybdenum as a constituent of the powdered metal binder results in a shaped charge liner having a higher sound speed as opposed to some of the traditionally used binder materials. As noted above, higher sound speeds are desired since a higher jet speed results in an increased penetration depth. Additionally, molybdenum has a higher density than most of the other traditional binder metals, such as copper and bismuth. Increasing the binder metal density will in turn increase the overall liner density. A liner having an increased density which are capable of forming jets with increased densities, which in turn enables the jet to produce a deeper shot penetration of the subject target. Increased hydrocarbon production is one advantage of deeper shot penetration during well bore perforating activities.

Tests were performed comparing the performance of shaped charges having prior art liners to shaped charges with liners comprised of a novel combination of tungsten/molybdenum blend. The prior art liners comprised about 80 percent tungsten by weight and about 20 percent by weight of lead. Two different novel blends of tungsten/molybdenum liners were tested for comparison to the prior art liners. One novel liner configuration, the CLG mix, had 80 percent tungsten by weight, 9 percent CLG-80 by weight, 6 percent lead by weight, 4 percent molybdenum by weight, and 1 percent graphite by weight, the other novel liner configuration, the copper mix, consisted of 80 percent tungsten by weight, 9 percent copper powder by weight, 6 percent lead by weight, 4 percent molybdenum by weight, and 1 percent graphite by weight. Both the tungsten/lead, and the novel tungsten/molybdenum liners were formed by compressing a powdered metal mixture of the liner constituents in a rotating die press.

Multiple test shots were performed of the shaped charges including the prior art liners of the tungsten lead blend, where the liners were chosen from the same production lot. The test shots involved axially discharging the shaped charges into a concrete cylinder, then measuring the depth of the hole created by the charge (penetration depth). The best four shots of shaped charges having prior art liners were recorded and compared to the best shots recorded of the shaped charges having liners comprised of the CLG-80 mix. Table 1 summarizes the test results of the tungsten/lead blend versus the CLG-80 mix. Similarly, and using the same type of target, a test was conducted comparing the shot performance of shaped charges with liners comprised of the copper mix versus shaped charges having prior art liners. Those test results are summarized in Table 2. A review of the test results tabulated in Table 1 and Table 2 indicates that the addition of molybdenum to the liner composition clearly enhances the penetration depth of the shaped charges, and therefore increases the performance of the shaped charge.

TABLE 1

| Charge mass (gms) | prior art liner penetration (inches) | CLG-mix penetration (inches) | % Improvement |
|---|---|---|---|
| 15 grams | 23.1" | 25.2"–25.7" | 9%–11% |
| 7 grams | 17.1" | 19.6"–19.8" | 15%–16% |
| 22 grams | 30.3" | 35.1"–35.6" | 16%–17% |

TABLE 2

| Charge Mass (gms) | prior art liner penetration (inches) | Copper Mix penetration (inches) | % Improvement |
|---|---|---|---|
| 7 grams | 16.8" | 18.4"–20.1" | 10%–20% |

The above specified preferred composition of the powdered metal binder in the liner mixture is not to be construed as an absolute limitation of the invention. A range of compositions of the preferred powdered metal mixture exist. Alternative composition ranges include powdered heavy metal from 50 to 97 percent by weight, the copper powder from 0 to 10 percent by weight, molybdenum from 0 to 14 percent by weight, lead from 0 to 8 percent by weight, and graphite from 0 to 1 percent by weight, other composition ranges include powdered heavy metal from 50 to 93 percent by weight, the copper powder from 0 to 10 percent by weight, molybdenum from 0 to 14 percent by weight, lead from 0 to 8 percent by weight, and graphite from 0 to 1 percent by weight. A list of specific compositions is included in Table 3.

TABLE 3

| Percent tungsten | Percent copper | percent lead | percent molybdenum | percent graphite |
|---|---|---|---|---|
| 85% | — | — | 14% | 1% |
| 82% | — | 8% | 9% | 1% |
| 85% | 10% (CLG-80) | — | 4% | 1% |
| 80% | 9% (CLG-80) | 6% | 4% | 1% |
| 80% | 9% (copper powder) | 6% | 4% | 1% |
| 82% | 7% (copper powder) | 6% | 4% | 1% |
| 85% | 5% (copper powder) | 5% | 4% | 1% |
| 90% | 2% (copper powder) | 3% | 4% | 1% |
| 88% (bi-modal tungsten | 6% (copper powder) | 5% | — | 1% |

The liner 5 can be retained in the housing 1 by application of adhesive 6. The adhesive 6 enables the shaped charge 10 to withstand the shock and vibration typically encountered during 20 handling and transportation without movement of the liner 5 or the explosive 2 within the housing 1. It is to be understood that the adhesive 6 is only used for retaining the liner 5 in position within the housing 1 and is not to be construed as a limitation on the invention.

The present invention described herein, therefore, is well adapted to carry out the objects and attain the ends and advantages mentioned, as well as others inherent therein. While a presently preferred embodiment of the invention has been given for purposes of disclosure, numerous changes in the details of procedures for accomplishing the desired results. For example, binders selected from the group consisting of lead, bismuth, zinc, tin, uranium, silver, gold, antimony, cobalt, zinc alloys, tin alloys, nickel, and palladium can be implemented. These and other similar modifications will readily suggest themselves to those skilled in the art, and are intended to be encompassed within the spirit of the present invention disclosed herein and the scope of the appended claims.

What is claimed is:

1. A liner for a shaped charge, which liner comprises:

a mixture of powdered heavy metal and a powdered metal binder compressively formed into a liner body, wherein said powdered metal binder comprises copper powder, lead, and molybdenum, said powdered heavy metal comprising from 50 percent by weight of said mixture to 97 percent by weight of said mixture, and said powdered metal binder comprising from 3 percent by weight of said mixture to 50 percent by weight of said mixture.

2. The liner for a shaped charge of claim 1 wherein said powdered heavy metal is comprised of tungsten.

3. The liner for a shaped charge of claim 1 wherein said powdered heavy metal is comprised of bi-modal tungsten.

4. The liner for a shaped charge of claim 1 further comprising a lubricant intermixed with said powdered heavy metal and said powdered metal binder.

5. The liner for a shaped charge of claim 4 wherein said lubricant is graphite.

6. The liner for shaped charge of claim 4 wherein said lubricant is oil.

7. The liner for a shaped charge of claim 1 wherein said copper powder comprises up to 10 percent by weight of said mixture of powdered heavy metal and powdered metal binder.

8. The liner for a shaped charge of claim 7, wherein said copper powder comprises a copper, lead, and graphite mixture.

9. The liner for a shaped charge of claim 7, wherein said copper powder comprises pure copper.

10. The liner for a shaped charge of claim 1 wherein said lead constituent of said powdered metal binder comprises up to 8 percent by weight of said mixture of powdered heavy metal and powdered metal binder.

11. The liner for a shaped charge of claim 1 wherein said molybdenum constituent of said powdered metal binder comprises up to 14 percent by weight of said mixture of powdered heavy metal and powdered metal binder.

12. The liner for a shaped charge of claim 1, wherein said powdered heavy metal is tungsten and comprises from 50 to 93 percent by weight of said mixture, and said binder comprises 7 to 50 percent of said mixture.

13. The liner for a shaped charge of claim 1, wherein said powdered heavy metal is tungsten and comprises from 50 to 90 percent by weight of said mixture, and said binder comprises 10 to 50 percent of said mixture.

14. The liner for a shaped charge of claim 1 where said powdered heavy metal is tungsten and comprises 85 percent by weight of said mixture and said powdered metal binder comprises 14 percent by weight of molybdenum of said mixture, and 1 percent by weight of graphite of said mixture.

15. The liner for a shaped charge of claim 1 where said powdered heavy metal is tungsten and comprises 82 percent by weight of said mixture and said powdered metal binder comprises 8 percent by weight of lead of said mixture, 9 percent by weight of molybdenum of said mixture, and 1 percent by weight of graphite of said mixture.

16. The liner for a shaped charge of claim 1 where said powdered heavy metal is tungsten and comprises 85 percent by weight of said mixture and said powdered metal binder comprises 10 percent by weight of a blend of powdered copper, powdered lead, and graphite of said mixture, 4 percent by weight of molybdenum of said mixture, and 1 percent by weight of graphite of said mixture, where the powdered copper, powdered lead, and graphite blend is comprised of 78–81 percent of copper, 18–20 percent of lead, and 0.9 to 1.0 percent of graphite.

17. The liner for a shaped charge of claim 1 where said powdered heavy metal is tungsten and comprises 80 percent by weight of said mixture and said powdered metal binder comprises 9 percent by weight of a blend of powdered copper, powdered lead, and graphite of said mixture, 6 percent by weight of lead of said mixture, 4 percent by weight of molybdenum of said mixture, and 1 percent by weight of graphite of said mixture, where the powdered copper, powdered lead, and graphite blend is comprised of 78–81 percent of copper, 18–20 percent of lead, and 0.9 to 1.0 percent of graphite.

18. The liner for a shaped charge of claim 1 where said powdered heavy metal is tungsten and comprises 80 percent by weight of said mixture and said powdered metal binder comprises 9 percent by weight of copper of said mixture, 6 percent by weight of lead of said mixture, 4 percent by weight of molybdenum of said mixture, and 1 percent by weight of graphite of said mixture.

19. The liner for a shaped charge of claim 1 where said powdered heavy metal is tungsten and comprises 82 percent by weight of said mixture and said powdered metal binder comprises 7 percent by weight of copper of said mixture, 6 percent by weight of lead of said mixture, 4 percent by weight of molybdenum of said mixture, and 1 percent by weight of graphite of said mixture.

20. The liner for a shaped charge of claim 1 where said powdered heavy metal is tungsten and comprises 85 percent by weight of said mixture and said powdered metal binder comprises 5 percent by weight of copper of said mixture, 5 percent by weight of lead of said mixture, 4 percent by weight of molybdenum of said mixture, and 1 percent by weight of graphite of said mixture.

21. The liner for a shaped charge of claim 1 where said powdered heavy metal is tungsten and comprises 90 percent by weight of said mixture and said powdered metal binder comprises 2 percent by weight of copper of said mixture, 3 percent by weight of lead of said mixture, 4 percent by weight of molybdenum of said mixture, and 1 percent by weight of graphite of said mixture.

22. The liner for a shaped charge of claim 1 where said powdered heavy metal is a bi-modal tungsten and comprises 88 percent by weight of said mixture and said powdered metal binder comprises 6 percent by weight of copper of said mixture, 5 percent by weight of lead of said mixture, and 1 percent by weight of graphite of said mixture.

23. A shaped charge comprising:

a housing;

a quantity of explosive inserted into said housing; and a liner inserted into said housing so that said quantity of explosive is positioned between said liner and said housing, said liner comprising a mixture of powdered heavy metal and a powdered metal binder compressively formed into a liner body, wherein said powdered metal binder comprises copper powder, lead, and molybdenum, said powdered heavy metal comprising from 50 percent by weight of said mixture to 97 percent by weight of said mixture, and said powdered metal binder comprising from 50 percent by weight of said mixture to 3 percent by weight of said mixture.

24. The liner of claim 23 wherein said powdered heavy metal is comprised of tungsten.

25. The liner of claim 23 wherein said powdered heavy metal is comprised of bi-modal tungsten.

26. The liner for a shaped charge of claim 23 further comprising a lubricant intermixed with said powdered heavy metal and said powdered metal binder.

27. The liner for a shaped charge of claim 26 wherein said lubricant is comprised of powdered graphite.

28. The liner for a shaped charge of claim 26 wherein said lubricant is comprised of oil.

29. The liner for a shaped charge of claim 23 wherein said copper powder comprises up to 10 percent by weight of said mixture of powdered heavy metal and powdered metal binder.

30. The liner for a shaped charge of claim 29, wherein said copper powder comprises a copper, lead, and graphite mixture.

31. The liner for a shaped charge of claim 29, wherein said copper powder comprises pure copper.

32. The liner for a shaped charge of claim 23 wherein said lead constituent of said powdered metal binder comprises up to 8 percent by weight of said mixture.

33. The liner for a shaped charge of claim 23 wherein said molybdenum constituent of said powdered metal binder comprises up to 14 percent by weight of said mixture of powdered heavy metal and powdered metal binder.

34. The liner for a shaped charge of claim 23, wherein said powdered heavy metal is tungsten and comprises from 50 to 93 percent by weight of said mixture, and said binder comprises from 7 to 50 percent of said mixture.

35. The liner for a shaped charge of claim 23, wherein said powdered heavy metal is tungsten and comprises from 50 to 90 percent by weight of said mixture, and said binder comprises from 10 to 50 percent of said mixture.

36. The liner for a shaped charge of claim 23 where said powdered heavy metal is tungsten and comprises 85 percent by weight of said mixture and said powdered metal binder comprises 14 percent by weight of molybdenum of said mixture, and 1 percent by weight of graphite of said mixture.

37. The liner for a shaped charge of claim 23 where said powdered heavy metal is tungsten and comprises 82 percent by weight of said mixture and said powdered metal binder comprises 8 percent by weight of lead of said mixture, 9 percent by weight of molybdenum of said mixture, and 1 percent by weight of graphite of said mixture.

38. The liner for a shaped charge of claim 23 where said powdered heavy metal is tungsten and comprises 85 percent by weight of said mixture and said powdered metal binder comprises 10 percent by weight of a blend of powdered copper, powdered lead, and graphite of said mixture, 4 percent by weight of molybdenum of said mixture, and 1 percent by weight of graphite of said mixture, where the powdered copper, powdered lead, and graphite blend is comprised of 78–81 percent of copper, 18–20 percent of lead, and 0.9 to 1.0 percent of graphite.

39. The liner for a shaped charge of claim 23 where said powdered heavy metal is tungsten and comprises 80 percent by weight of said mixture and said powdered metal binder comprises 9 percent by weight of a blend of powdered copper, powdered lead, and graphite of said mixture, 6 percent by weight of lead of said mixture, 4 percent by weight of molybdenum of said mixture, and 1 percent by weight of graphite of said mixture, where the powdered copper, powdered lead, and graphite blend is comprised of 78–81 percent of copper, 18–20 percent of lead, and 0.9 to 1.0 percent of graphite.

40. The liner for a shaped charge of claim 23 where said powdered heavy metal is tungsten and comprises 80 percent by weight of said mixture and said powdered metal binder comprises 9 percent by weight of copper of said mixture, 6 percent by weight of lead of said mixture, 4 percent by weight of molybdenum of said mixture, and 1 percent by weight of graphite of said mixture.

41. The liner for a shaped charge of claim 23 where said powdered heavy metal is tungsten and comprises 82 percent by weight of said mixture and said powdered metal binder comprises 7 percent by weight of copper of said mixture, 6 percent by weight of lead of said mixture, 4 percent by weight of molybdenum of said mixture, and 1 percent by weight of graphite of said mixture.

42. The liner for a shaped charge of claim 23 where said powdered heavy metal is tungsten and comprises 85 percent by weight of said mixture and said powdered metal binder comprises 5 percent by weight of copper of said mixture, 5 percent by weight of lead of said mixture, 4 percent by weight of molybdenum of said mixture, and 1 percent by weight of graphite of said mixture.

43. The liner for a shaped charge of claim 23 where said powdered heavy metal is tungsten and comprises 90 percent by weight of said mixture and said powdered metal binder comprises 2 percent by weight of copper of said mixture, 3 percent by weight of lead of said mixture, 4 percent by weight of molybdenum of said mixture, and 1 percent by weight of graphite of said mixture.

44. The liner for a shaped charge of claim 23 where said powdered heavy metal is a bi-modal tungsten and comprises 88 percent by weight of said mixture and said powdered metal binder comprises 6 percent by weight of copper of said mixture, 5 percent by weight of lead of said mixture, and 1 percent by weight of graphite of said mixture.

* * * * *